US011645965B2

(12) United States Patent
Hu et al.

(10) Patent No.: US 11,645,965 B2
(45) Date of Patent: May 9, 2023

(54) IMAGE PROCESSING METHOD AND DEVICE

(71) Applicants: HEFEI XINSHENG OPTOELECTRONICS TECHNOLOGY CO., LTD., Anhui (CN); BOE TECHNOLOGY GROUP CO., LTD., Beijing (CN)

(72) Inventors: Shenghua Hu, Beijing (CN); Chunyang Nie, Beijing (CN); Ruilian Li, Beijing (CN); Xueqin Wei, Beijing (CN); Ke Dai, Beijing (CN)

(73) Assignees: HEFEI XINSHENG OPTOELECTRONICS TECHNOLOGY CO., LTD., Anhui (CN); BOE TECHNOLOGY GROUP CO., LTD., Beijing (CN)

( * ) Notice: Subject to any disclaimer, the term of this patent is extended or adjusted under 35 U.S.C. 154(b) by 441 days.

(21) Appl. No.: 17/043,419

(22) PCT Filed: Sep. 26, 2019

(86) PCT No.: PCT/CN2019/108257
§ 371 (c)(1),
(2) Date: Sep. 29, 2020

(87) PCT Pub. No.: WO2021/056351
PCT Pub. Date: Apr. 1, 2021

(65) Prior Publication Data
US 2023/0116630 A1 Apr. 13, 2023

(51) Int. Cl.
*G09G 3/20* (2006.01)
*G09G 3/36* (2006.01)

(52) U.S. Cl.
CPC ..... *G09G 3/2074* (2013.01); *G09G 3/3607* (2013.01); *G09G 2300/0452* (2013.01);
(Continued)

(58) Field of Classification Search
CPC ..... G09G 3/2074; G09G 3/3607; G09G 2300/0452; G09G 2300/0478;
(Continued)

(56) References Cited

U.S. PATENT DOCUMENTS 8,988,469 B2 * 3/2015 Kang ..... G09G 3/3426 345/98
2008/0111828 A1 * 5/2008 Ahn ..... G09G 3/3688 345/605

(Continued)

*Primary Examiner* — Kenneth B Lee, Jr.
(74) *Attorney, Agent, or Firm* — Procopio, Cory, Hargreaves & Savitch LLP

(57) ABSTRACT

An image processing method includes: constructing an image data analysis model; obtaining a first gray level of at least one of a plurality of first sub-pixels, and second gray levels of at least two second sub-pixels corresponding to each of the at least one first sub-pixel; obtaining a first light transmittance corresponding to the first gray level of the at least one first sub-pixel, and second light transmittances corresponding to the second gray levels of the at least two second sub-pixels corresponding to each of the at least one first sub-pixel, and determining actual light transmittances corresponding to the second gray levels of the at least two second sub-pixels respectively according to the image data analysis model; and obtaining target light transmittances corresponding to the second gray levels of the at least two second sub-pixels respectively, and determining compensation gray levels corresponding to the at least two second sub-pixels according to the actual light transmittances corresponding to the second gray levels of the at least two second sub-pixels and the target light transmittances corresponding thereto.

12 Claims, 5 Drawing Sheets

(52) U.S. Cl.
CPC ..... *G09G 2300/0478* (2013.01); *G09G 2320/066* (2013.01); *G09G 2320/0673* (2013.01); *G09G 2360/147* (2013.01); *G09G 2360/16* (2013.01)

(58) Field of Classification Search
CPC ..... G09G 2320/066; G09G 2320/0673; G09G 2360/147; G09G 2360/16
See application file for complete search history.

(56) References Cited

U.S. PATENT DOCUMENTS

| | | | | |
|---|---|---|---|---|
| 2011/0141166 | A1* | 6/2011 | Ahn | G09G 3/3426 345/691 |
| 2012/0206502 | A1* | 8/2012 | Jung | G09G 3/342 345/690 |
| 2016/0093255 | A1* | 3/2016 | Aoki | G06F 3/04166 345/88 |
| 2020/0279534 | A1* | 9/2020 | Ji | G09G 3/3648 |

* cited by examiner

IMAGE PROCESSING METHOD AND DEVICE

CROSS-REFERENCE TO RELATED APPLICATION

This application is a national phase entry under 35 USC 371 of International Patent Application No. PCT/CN2019/108257 filed on Sep. 26, 2019, which is incorporated herein by reference in its entirety.

TECHNICAL FIELD

The present disclosure relates to the field of display technologies, and in particular, to an image processing method and an image processing device.

BACKGROUND

With the development of liquid crystal display screens, people have increasingly demands on performance of the liquid crystal display screen in energy conservation, image quality, etc. For example, the liquid crystal display screen is required to have ultra-high contrast.

SUMMARY

In one aspect, an image processing method is provided, which is applied to a display panel. The display panel includes a dimming sub-panel and a display sub-panel that are disposed in a stack. The dimming sub-panel includes a plurality of first sub-pixels, and the display sub-panel includes a plurality of second sub-pixels, wherein each of the plurality of first sub-pixels corresponds to at least two of the plurality of second sub-pixels.

The image processing method includes:

constructing an image data analysis model, the image data analysis model is used to represent a relationship among an actual light transmittance of the display panel, a first light transmittance of the dimming sub-panel and a second light transmittance of the display sub-panel;

obtaining a first gray level of at least one of the plurality of first sub-pixels, and second gray levels of at least two second sub-pixels corresponding to each of the at least one first sub-pixel;

obtaining a first light transmittance corresponding to the first gray level of the at least one first sub-pixel and second light transmittances corresponding to the second gray levels of the at least two second sub-pixels corresponding to each of the at least one first sub-pixel, and determining actual light transmittances corresponding to the second gray levels of the at least two second sub-pixels respectively according to the image data analysis model; and obtaining target light transmittances corresponding to the second gray levels of the at least two second sub-pixels respectively, and determining compensation gray levels corresponding to the at least two second sub-pixels according to the actual light transmittances and the target light transmittances corresponding to the second gray levels of the at least two second sub-pixels corresponding thereto.

In some embodiments, constructing the image data analysis model, includes:

obtaining the first light transmittance corresponding to the dimming sub-panel and the second light transmittance corresponding to the display sub-panel at each of at least four gray levels according to a first gamma curve of the dimming sub-panel and a second gamma curve of the display sub-panel;

obtaining a third gamma curve corresponding to the display panel at an actual display state, and determining the actual light transmittance corresponding to the display panel at each of the at least four gray levels according to the third gamma curve; and taking the first light transmittance of the dimming sub-panel and the second light transmittance of the display sub-panel as independent variables, the actual light transmittance of the display panel as a dependent variable, and performing a nonlinear regression analysis, so as to construct the image data analysis model.

In some embodiments, obtaining the target light transmittances corresponding to the second gray levels of the at least two second sub-pixels, includes: obtaining the target light transmittances corresponding to the second gray levels of the at least two second sub-pixels according to the third gamma curve of the display panel respectively.

In some embodiments, the nonlinear regression analysis includes:

supposing a model expression, the model expression is $z=a_0+a_1x+a_2y+a_3xy+a_4x^2+a_5y^2$, where x is the first light transmittance of the dimming sub-panel, y is the second light transmittance of the display sub-panel, z is the actual light transmittance of the display panel, and $a_0$ to $a_5$ are different coefficients in the model expression; and substituting values of x, y and z corresponding to each of the at least four gray levels into the model expression, and using an analysis tool to obtain values of different coefficients in the model expression and analysis results.

In some embodiments, determine actual light transmittances corresponding to the second gray levels of the at least two second sub-pixels respectively by using the image data analysis model, includes:

taking the first light transmittance corresponding to the first gray level of the at least one first sub-pixel as a value of x, the second light transmittance corresponding to a second gray level of each of the at least two second sub-pixels corresponding to each of the at least one first sub-pixel as a value of y, and substituting them into the model expression of the image data analysis model; and respectively determining actual light transmittances corresponding to the second gray levels of the at least two second sub-pixels corresponding to each of the at least one first sub-pixel according to the model expression.

In some embodiments, obtaining a first light transmittance corresponding to the first gray level of the at least one first sub-pixel and second light transmittances corresponding to the second gray levels of the at least two second sub-pixels corresponding to each of the at least one first sub-pixel, includes:

obtaining the first light transmittance corresponding to the first gray level of the at least one first sub-pixel according to a first gamma curve of the dimming sub-panel; and obtaining the second light transmittances corresponding to the second gray levels of the at least two second sub-pixels corresponding to each of the at least one first sub-pixel according to a second gamma curve of the display sub-panel.

In some embodiments, before determining compensation gray levels corresponding to the at least two second sub-pixels, the method further includes: judging whether to compensate for a second gray level of each of the at least two second sub-pixels according to a difference between the actual light transmittance corresponding to the second gray level of each of the at least two second sub-pixels and the target light transmittance corresponding thereto; and if yes, determining a compensation gray level corresponding to each of the at least two second sub-pixels.

In some embodiments, judging whether to compensate fora second gray level of each of the at least two second sub-pixels, includes: obtaining a difference between an actual light transmittance and a target light transmittance corresponding to the second gray level of each of the at least two second sub-pixels; judging whether an absolute value of the difference is greater than or equal to a threshold; and if yes, compensating for the second gray level of the second sub-pixel corresponding to the difference.

In some embodiments, determining a compensation gray level of the second sub-pixel corresponding to the difference, includes:

judging whether the actual light transmittance corresponding to the second gray level of the second sub-pixel is greater than the target light transmittance corresponding thereto;

if yes, reducing the second gray level of the second sub-pixel by stages until the absolute value of the difference between the actual light transmittance and the target light transmittance corresponding to the second gray level of the second sub-pixel is less than the threshold, then the reduced second gray level of the second sub-pixel is the compensation gray level corresponding to the second sub-pixel; and if not, increasing the second gray level of the second sub-pixel by stages until the absolute value of the difference between the actual light transmittance and the target light transmittance corresponding to the second gray level of the second sub-pixel is less than the threshold, then the increased second gray level of the second sub-pixel is the compensation gray level corresponding to the second sub-pixel.

In some embodiments, the threshold is 0.995% to 1.005%.

In another aspect, an image processing device is provided. The image processing device includes:

a model construction unit configured to construct the image data analysis model, the image data analysis model is used to represent the relationship among the actual light transmittance of the display panel, the first light transmittance of the dimming sub-panel and the second light transmittance of the display sub-panel;

an obtaining unit configured to obtain the first gray level of the at least one of the plurality of first sub-pixels, and the second gray levels of the at least two second sub-pixels corresponding to each of the at least one first sub-pixel;

a first determination unit configured to obtain the first light transmittance corresponding to the first gray level of the at least one first sub-pixel and the second light transmittances corresponding to the second gray levels of the at least two second sub-pixels corresponding to each of the at least one first sub-pixel, and determine the actual light transmittances corresponding to the second gray levels of the at least two second sub-pixels according to the image data analysis model respectively; and a second determination unit configured to respectively obtain the target light transmittances corresponding to the second gray levels of the at least two second sub-pixels, and determine the compensation gray levels corresponding to the at least two second sub-pixels according to the actual light transmittances and the target light transmittances corresponding to the second gray levels of the at least two second sub-pixels.

In yet another aspect, an image processing device is provided. The image processing device includes a processor and a memory. The processor is electrically connected to the display panel. The memory stores computer program instructions suitable for being executed by the processor, and when the computer program instructions are run by the processor, one or more steps in the image processing method as described in any of the above embodiments are executed.

BRIEF DESCRIPTION OF THE DRAWINGS

In order to describe technical solutions in some embodiments of the present disclosure more clearly, the accompanying drawings to be used in the description of some embodiments will be introduced briefly. Obviously, the accompanying drawings to be described below are merely some embodiments of the present disclosure, and a person of ordinary skill in the art can obtain other drawings according to these drawings without paying any creative effort.

DETAILED DESCRIPTION

The technical solutions in some embodiments of the present disclosure will be described clearly and completely in combination with the accompanying drawings in some embodiments of the present disclosure. Obviously, the described embodiments are merely some but not all of the embodiments of the present disclosure. All other embodiments obtained on a basis of some embodiments of the present disclosure by a person of ordinary skill in the art shall be included in the protection scope of the present disclosure.

With the development of liquid crystal display screens, people have increasingly demands on performance of the liquid crystal display screen in energy conservation, image quality, etc. For example, the liquid crystal display screen is required to have ultra-high contrast.

Figure 1:
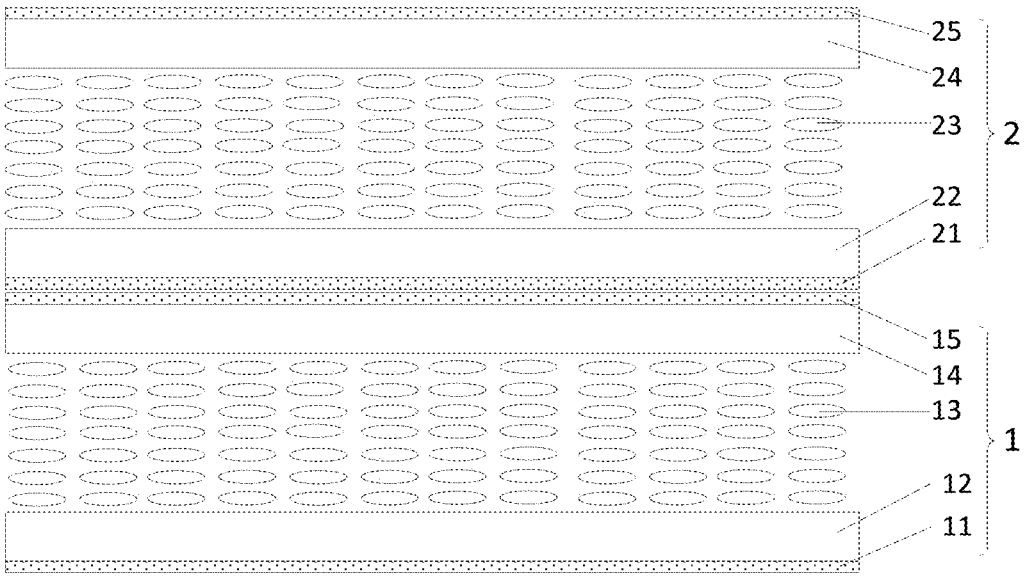
FIG. 1 is a schematic diagram of a display panel, in accordance with some embodiments of the present disclosure.
Figure 2:
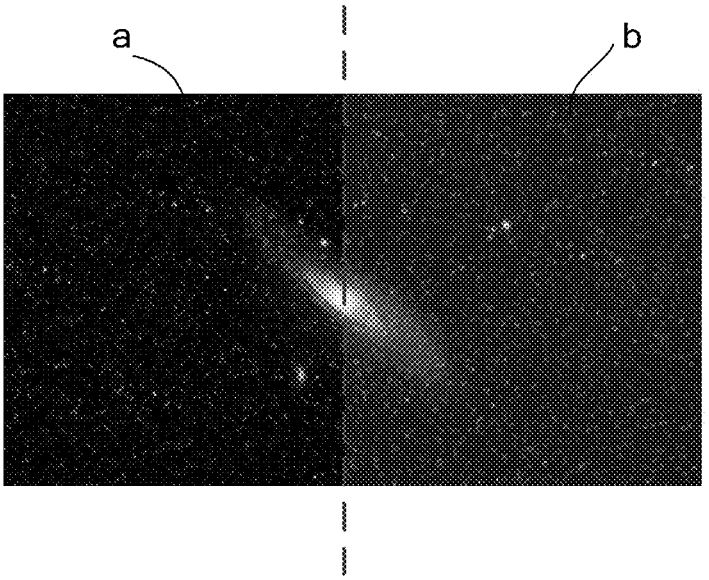
FIG. 2 is a schematic comparison diagram of two display images, in accordance with some embodiments of the present disclosure.

On this basis, some embodiments of the present disclosure provide a liquid crystal display screen with dual sub-panels (dual cell). As shown in FIG. 1, a display panel of the liquid crystal display screen (dual cell) includes a display sub-panel 2, a dimming sub-panel 1 and a backlight source (not shown in the drawing) that are disposed in a stack. The dimming sub-panel 1 is disposed between the backlight source and the display sub-panel 2, that is, the dimming sub-panel 1 is disposed at a light entry side of the display sub-panel 2. The display sub-panel 2 is provided with an RGB filter, and can perform color display; the display sub-panel 2 is configured to realize a display function of the display panel. The dimming sub-panel 1 is not provided with the RGB filter, and can perform pure gray-scale display; the dimming sub-panel 1 is configured to perform regional dimming of the display sub-panel 2. The regional dimming of the display sub-panel 2 through the dimming sub-panel 1 enables the display panel of the liquid crystal display screen to perform finer brightness adjustment in a sub-millimeter range, thereby realizing ultra-high level and ultra-high dynamic contrast of the liquid crystal display screen (e.g., greater than 100,000:1). For example, as shown in FIG. 2, with the dotted line as a boundary, an image a displayed by a dual cell liquid crystal display screen is at the left side of the dotted line, and an image b displayed by an ordinary liquid crystal display screen is at the right side of the dotted line. The contrast of the image a at the left side of the dotted line is higher; display effect of the dual cell liquid crystal display screen is better.

For example, with continued reference to FIG. 1, the dimming sub-panel 1 includes a first polarizer 11, a first base substrate 12, a first liquid crystal layer 13, a second base substrate 14 and a second polarizer 15. The display sub-panel 2 includes a third polarizer 21, a third base substrate 22, a second liquid crystal layer 23, a fourth base substrate 24 and a fourth polarizer 25. The first polarizer 11 is disposed at a light entry side of the dimming sub-panel 1, and the second polarizer 15 is disposed at a light exit side of the dimming sub-panel. The third polarizer 21 is disposed at the light entry side of the display sub-panel 2, and the fourth polarizer 25 is disposed at a light exit side of the display sub-panel 2.

In addition, for example, the second polarizer 15 may be multiplexed into the third polarizer 21. That is, a single polarizer is disposed between the dimming sub-panel 1 and the display sub-panel 2, thereby simplifying a structure of the display panel, and reducing a thickness of the display panel.

Herein, it will be noted that, FIG. 1 schematically illustrates structures of dual sub-panels in the display panel in some embodiments of the present disclosure, and only briefly illustrates the structure of the dimming sub-panel 1 and that of the display sub-panel 2.

In some embodiments, the dimming sub-panel 1 includes a plurality of first sub-pixels, and the display sub-panel 2 includes a plurality of second sub-pixels. Resolution of the dimming sub-panel 1 is lower than resolution of the display sub-panel 2. Therefore, each of the plurality of first sub-pixels of the dimming sub-panel 1 corresponds to at least two second sub-pixels of the display sub-panel 2. That is, orthographic projections of the at least two second sub-pixels corresponding to each first sub-pixel on the dimming sub-panel 1 is within a range of the first sub-pixel. In addition, for clarity of illustration, some embodiments of the present disclosure define each first sub-pixel 101 of the dimming sub-panel 1 and at least two second sub-pixels of the display sub-panel 2 corresponding thereto as a group of sub-pixels.

Figure 3:
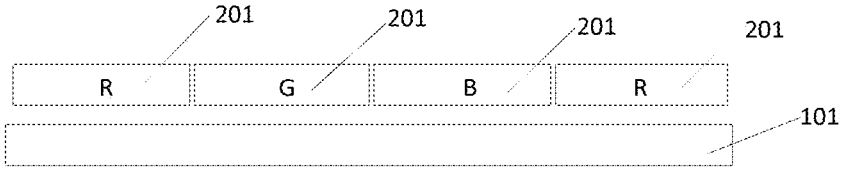
FIG. 3 is a schematic diagram showing a corresponding relationship between a first sub-pixel and a second sub-pixel in a group of sub-pixels, in accordance with some embodiments of the present disclosure.

In some examples, the dimming sub-panel 1 has 2k resolution; a standard of the 2k resolution is 1920×1080. The display sub-panel 2 has 4k resolution; a standard of the 4k resolution is 3840×2160. In this case, as shown in FIG. 3, each of a plurality of first sub-pixels 101 of the dimming sub-panel 1 corresponds to four second sub-pixels 201 of the display sub-panel 2. That is, any group of sub-pixels includes one first sub-pixel 101 and four second sub-pixels 201 corresponding thereto. Herein, it will be added that, some embodiments of the present disclosure do not limit a shape of the first sub-pixel 101 and a shape of the second sub-pixel 102.

In addition, the resolution of the dimming sub-panel 1 and the display sub-panel 2 may be set in other ways, as long as the resolution of the dimming sub-panel 1 is lower than the resolution of the display sub-panel 2. For example, the dimming sub-panel 1 has 2k resolution, and the display sub-panel 2 has 8k resolution. In this case, each of the plurality of first sub-pixels 101 in the dimming sub-panel 1 corresponds to sixteen second sub-pixels 201 in the display sub-panel 2. Some embodiments of the present disclosure only illustrate the image processing method in some embodiments of the present disclosure by taking the dimming sub-panel 1 having 2k resolution and the display sub-panel 2 having 4k resolution as an example.

Figure 4:
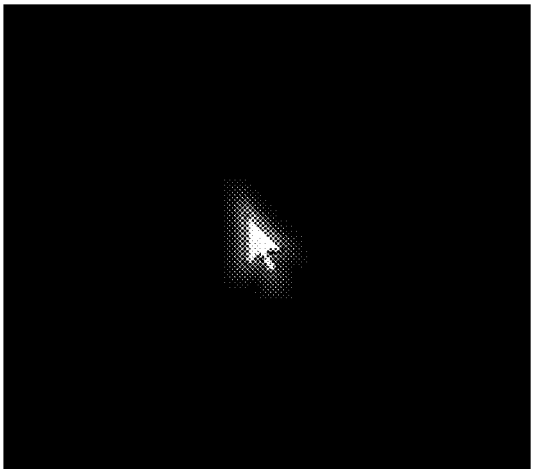
FIG. 4 is a schematic diagram showing that a halo phenomenon appears in a display image, in accordance with some embodiments of the present disclosure.

On this basis, in any group of sub-pixels, a gray level of at least one of the four second sub-pixels 201 in the display sub-panel 2 differs from a gray level of a corresponding first sub-pixel 101 in the dimming sub-panel 1. In this case, the at least one second sub-pixel 201 among the four second sub-pixels 201, the gray level of which differs from the gray level of the corresponding first sub-pixel 101, is brighter or darker, resulting in a halo phenomenon when the display panel displays an image. For example, as shown in FIG. 4, when the dual cell liquid crystal display screen displays an arrow icon, halo appears around the arrow icon.

For example, in any group of sub-pixels, a first gray level of one first sub-pixel 101 in the dimming sub-panel 1 corresponds to second gray levels of four second sub-pixels 201 in the display sub-panel 2. In addition, each first sub-pixel 101 corresponds to a first gray level, and each second sub-pixel 201 corresponds to a second gray level. For clarity of illustration, one first gray level corresponding to four second gray levels in each group of sub-pixels is used to describe different situations in which halo appears when the display sub-panel 2 of the present disclosure displays an image.

In some examples, in any group of sub-pixels, the first gray level is equal to the largest second gray level among the four second gray levels corresponding thereto. As a result, in the four second gray levels, second light transmittances corresponding to the second gray levels that are not equal to the first gray level are relatively high, resulting in second sub-pixels 201 corresponding to the second gray levels related to relatively high second light transmittances being relatively bright, and then causing halo to appear when the display sub-panel 2 displays an image.

In some other examples, in any group of sub-pixels, the first gray level is equal to the smallest second gray level among the four second gray levels corresponding thereto. As a result, in the four second gray levels, second light transmittances corresponding to the second gray levels that are not equal to the first gray level are relatively low, resulting in second sub-pixels 201 corresponding to the second gray levels related to relatively low second light transmittances being relatively dark, and then causing halo to appear when the display sub-panel 2 displays an image.

In some other examples, in any group of sub-pixels, the first gray level is equal to an average value of the four second gray levels corresponding thereto. As a result, among the four second gray levels, second light transmittances corresponding to the second gray levels that are not equal to the first gray level are relatively high or relatively low. As a result, the second sub-pixel 201 corresponding to the second gray level related to the relatively high second light transmittance is relatively bright, and the second sub-pixel 201 corresponding to the second gray level related to the relatively low second light transmittance is relatively dark, and then causing halo to appear when the display sub-panel 2 displays an image.

Figure 5:
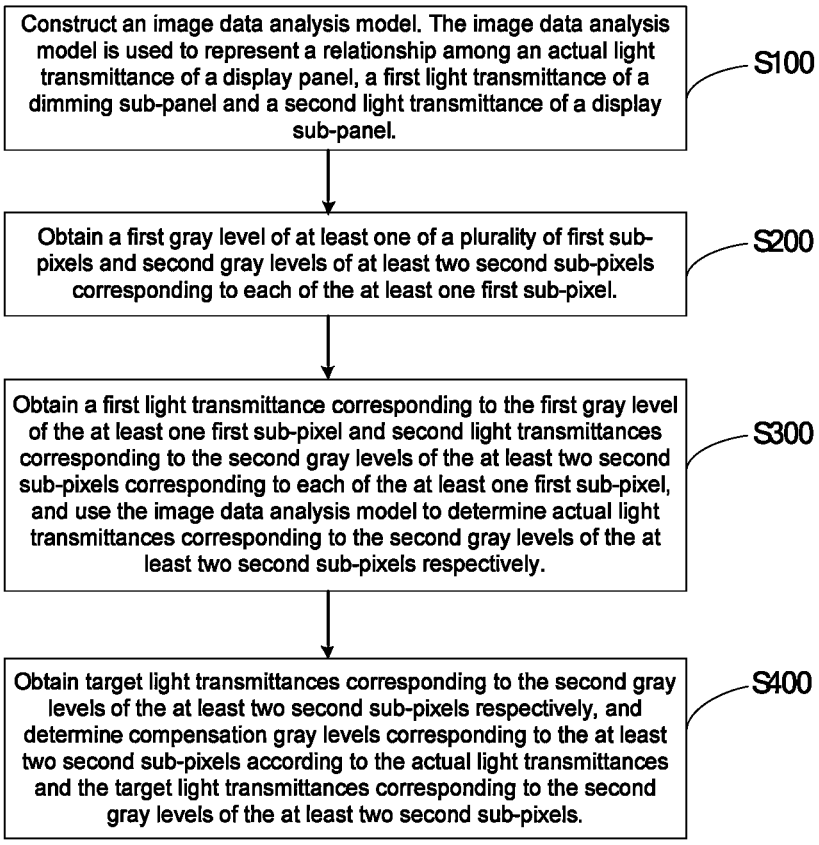
FIG. 5 is a schematic flow diagram of an image processing method, in accordance with some embodiments of the present disclosure.
Figure 6:
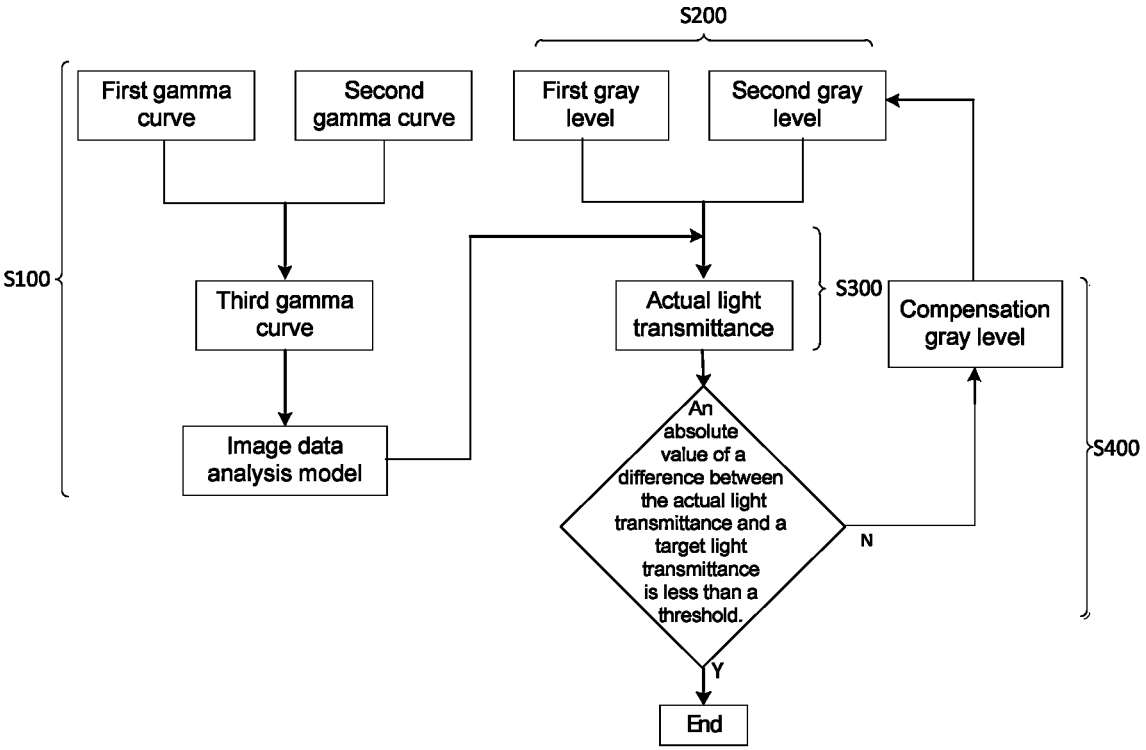
FIG. 6 is a schematic flow diagram of another image processing method, in accordance with some embodiments of the present disclosure.

On this basis, some embodiments of the present disclosure provide an image processing method applied to the display panel, as shown in FIGS. 5 and 6, including S100 to S400.

In S100, an image data analysis model is constructed. The image data analysis model is used to represent a relationship among an actual light transmittance of the display panel, a first light transmittance of the dimming sub-panel 1 and a second light transmittance of the display sub-panel 2.

In some examples, bit depth of the dimming sub-panel 1 and bit depth of the display sub-panel 2 are both eight, i.e., 8-bit. Bit depth is used to indicate the number of colors of each sub-pixel of the dimming sub-panel 1 and the display sub-panel 2, i.e., gradations of color. The greater the number of bits of the bit depth, the more the gradations, and the more uniform and smooth the color transition. Each sub-pixel of the dimming sub-panel 1 and the display sub-panel 2 can display color (or brightness) gradations of two to the eighth power (i.e., 256), so that images displayed on the dimming sub-panel 1 and the display sub-panel 2 have 256 colors or 256 gray levels (i.e., 0 to 255, a total of 256 levels).

On this basis, in some examples, the first gray level of the first sub-pixel 101 of the dimming sub-panel 1 includes 256 levels (i.e., 0 to 255), and the second gray level of the second sub-pixel 201 of the display sub-panel 2 also includes 256 levels (i.e., 0 to 255). It will be noted that, the display panel is formed by stacking and bonding the dimming sub-panel 1 and the display sub-panel 2, and the display panel substantially displays images through the display sub-panel 2. Therefore, the display panel also has 256 gray levels (i.e., 0 to 255, a total of 256 levels). In addition, the bit depth of the dimming sub-panel 1 and the bit depth of the display sub-panel 2 may also be set in other ways, such as 10-bit. Some embodiments of the present disclosure are described only by taking 8-bit as an example.

Figure 7:
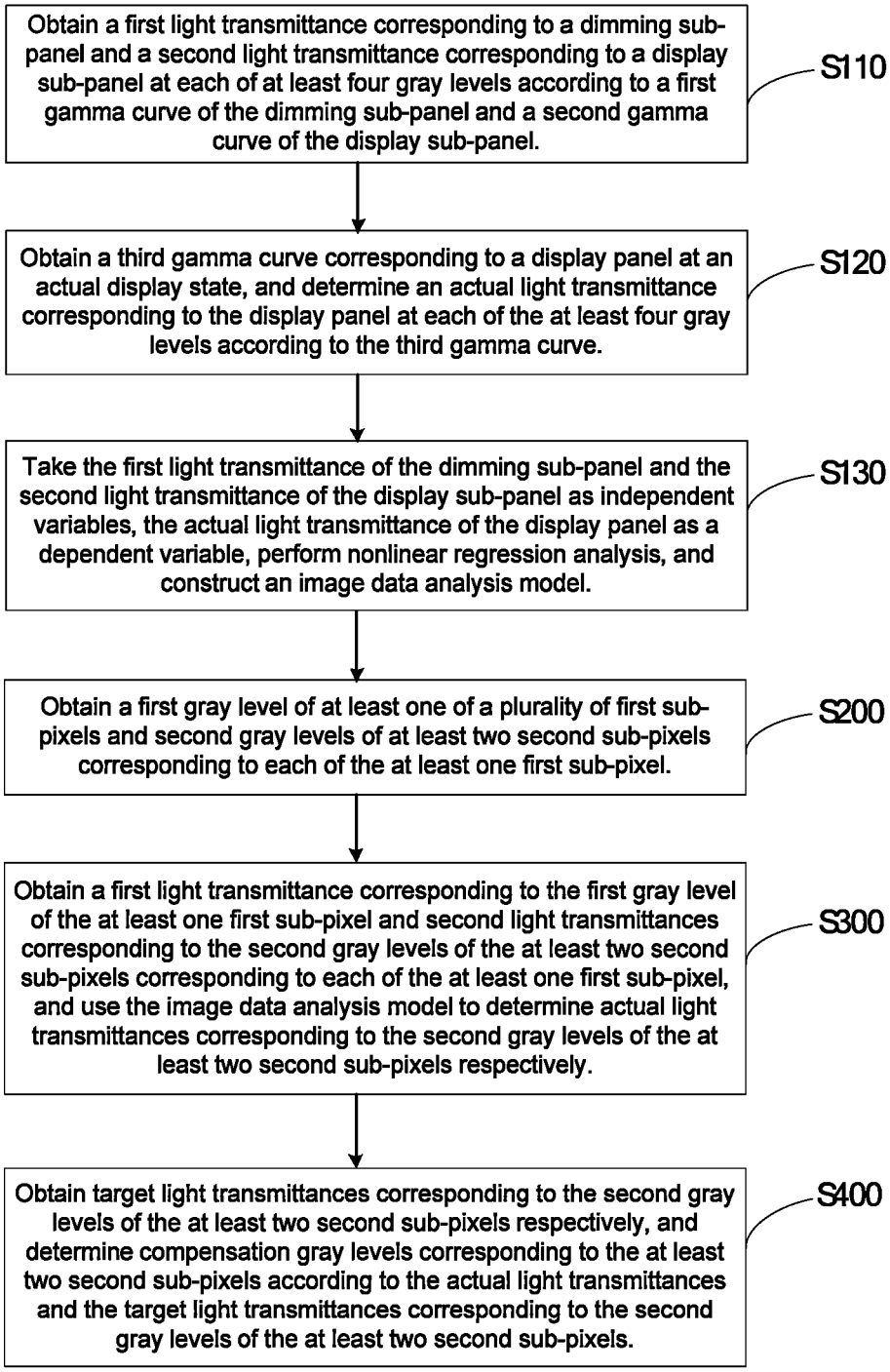
FIG. 7 is a schematic flow diagram of yet another image processing method, in accordance with some embodiments of the present disclosure.

In some embodiments, as shown in FIG. 7, S100: constructing an image data analysis model, further includes S110 to S130.

In S110, the first light transmittance corresponding to the dimming sub-panel 1 and the second light transmittance corresponding to the display sub-panel 2 at each of at least four gray levels are obtained according to a first gamma curve of the dimming sub-panel 1 and a second gamma curve of the display sub-panel 2.

In S120, a third gamma curve corresponding to the display panel at an actual display state is obtained, and the actual light transmittance corresponding to the display panel at each of the at least four gray levels is determined according to the third gamma curve.

Figure 8:
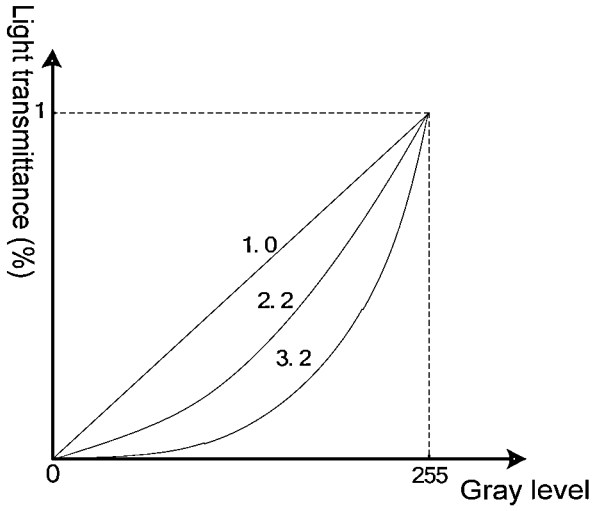
FIG. 8 is a schematic diagram of gamma curves, in accordance with some embodiments of the present disclosure.

Herein, the gamma curve is used to represent a relationship between the gray level and brightness. The brightness may be represented by light transmittance. That is, with respect to a known gamma curve and the gray level, the light transmittance corresponding to the known gray level may be obtained through the known gamma curve. For example, as shown in FIG. 8, it is a schematic diagram of a gamma 1.0 curve, a gamma 2.2 curve, and a gamma 3.2 curve.

In some examples, a gamma curve of the dimming sub-panel 1 is the first gamma curve (e.g., the gamma 1.0 curve), and a gamma curve of the display sub-panel 2 is the second gamma curve (e.g., the gamma 2.2 curve). In a case where the first gamma curve of the dimming sub-panel 1 is the gamma 1.0 curve, and the second gamma curve of the display sub-panel 2 is the gamma 2.2 curve, a third gamma curve of the display panel formed by stacking and bonding the dimming sub-panel 1 and the display sub-panel 2 may be obtained after measurement. For example, the third gamma curve is the gamma 3.2 curve. Herein, the measurement method is to use an optical instrument to measure, for example, the display panel is measured by using a color analyzer or a colorimeter, so as to obtain the third gamma curve of the display panel.

On this basis, the first light transmittance corresponding to the gray level of the dimming sub-panel 1 may be obtained through the first gamma curve, and the second light transmittance corresponding to the gray level of the display sub-panel 2 may be obtained through the second gamma curve, and the actual light transmittance corresponding to the gray level of the display panel may be obtained through the third gamma curve.

In S130, the first light transmittance of the dimming sub-panel 1 and the second light transmittance of the display sub-panel 2 are taken as independent variables, the actual light transmittance of the display panel is taken as a dependent variable, then a nonlinear regression analysis is performed, and the image data analysis model is constructed.

In some embodiments, S130: performing the nonlinear regression analysis includes S131 and S132.

In S131, a model expression is supposed, and the model expression is:

$$z=a_0+a_1x+a_2y+a_3xy+a_4x^2+a_5y^2 \quad (1)$$

Where x is the first light transmittance of the dimming sub-panel 1, y is the second light transmittance of the display sub-panel 2, z is the actual light transmittance of the display panel, and $a_0$ to $a_5$ are coefficients in the model expression (1).

In S132, in an analysis tool, values of x, y and z corresponding to each gray level are substituted into the model expression, so as to obtain values of different coefficients in the model expression and analysis results.

In some examples, in a case where the first gamma curve of the dimming sub-panel 1 is known, the first light transmittance corresponding to each level of the first gray level (0 to 255, a total of 256 levels) of each first sub-pixel 101 in the dimming sub-panel 1 may be obtained. In a case where the second gamma curve of the display sub-panel 2 is known, the second light transmittance corresponding to each level of the second gray level (0 to 255, a total of 256 levels) of each second sub-pixel 201 in the display sub-panel 2 may be obtained. In addition, in a case where the third gamma curve of the display panel is known, the corresponding actual light transmittance of the display panel at each level of the gray level (0 to 255, a total of 256 levels) may be obtained.

Further, in the analysis tool, the supposed model expression (1) is entered, and then the first light transmittance (x), the second light transmittance (y) and the actual light transmittance (z) corresponding to each of at least four gray levels are entered. That is, the values of x, y and z are substituted into the model expression (1); x and y are the independent variables, and z is the dependent variable. Values of the coefficients $a_0$ to $a_5$ in the model expression (1) and the analysis results may be obtained through results output by the analysis tool.

In some examples, the analysis tool is "statistical product and service solutions" (SPSS) software. On this basis, the analysis results include a correlation coefficient R and a value P; the correlation coefficient R is used to measure a degree of correlation between the independent variables x and y, and the value P is a decreasing index indicating the confidence level of the result, the greater the value p, the smaller the confidence level of the result. Some embodiments of the present disclosure use SPSS software to perform nonlinear regression analysis, so as to illustrate the construction of the image data analysis model in S100.

For example, at least four gray levels (i.e. samples) among 256 gray levels (0 to 255) are selected. For example, four samples are selected, which are a gray level 1, a gray level 63, a gray level 127, and a gray level 191. The gray level 1 indicates that a level of the gray level is 1. In some examples of the present disclosure, only four samples are selected for illustration. Herein, considering the complexity of data, the number of decimal places of the data is kept to three places.

According to the first gamma curve (e.g., the gamma 1.0 curve), a first light transmittance corresponding to the gray level 1 is 0.392%, a first light transmittance corresponding to the gray level 63 is 24.706%, a first light transmittance corresponding to the gray level 127 is 24.706%, and a first light transmittance corresponding to the gray level 191 is 74.902%, which are respectively obtained.

According to the second gamma curve (e.g., the gamma 2.2 curve), a second light transmittance corresponding to the gray level 1 is 0.001%, a second light transmittance corresponding to the gray level 63 is 4.615%, a second light transmittance corresponding to the gray level 127 is 21.576%, and a second light transmittance corresponding to the gray level 191 is 52.952%, which are respectively obtained.

According to the third gamma curve (e.g., the gamma 3.2 curve), an actual light transmittance corresponding to the gray level 1 is 0.000% (which is not absolutely 0, and is a result with three decimal places kept), an actual light transmittance corresponding to the gray level 63 is 1.140%, an actual light transmittance corresponding to the gray level 127 is 10.746%, and an actual light transmittance corresponding to the gray level 191 is 39.662%, which are respectively obtained.

Herein, it will be noted that, the greater the number of samples selected from 0 to 255 gray levels, the better fitting effect of the model expression finally obtained. In some examples of the present disclosure, only four gray levels are selected for a schematic description, and in actual operation, more than four samples will be selected for analysis.

Further, the supposed model expression (1) and light transmittances corresponding to selected gray levels are entered into the SPSS software. For example, at the time of entering, the first light transmittance 0.392% corresponding to the gray level 1 according to the first gamma curve is taken as x, the second light transmittance 0.001% corresponding to the gray level 1 according to the second gamma curve is taken as y, and the actual light transmittance 0.000% corresponding to the gray level 1 according to the third gamma curve is taken as z. Methods of entering light transmittances corresponding to other gray levels are deduced by analogy, which will not be repeated here. After data of all the sample gray levels are entered, the analysis results are output in the SPSS software.

For example, as shown in Table 1, Table 2 and Table 3, these are the analysis results output by the SPSS software.

TABLE 1

| | |
|---|---|
| Correlation coefficient (R) | 1 |
| Coefficient of determination of sample ($R^2$) | 1 |
| Adjusted R square | 1 |
| Standard error | 2.47624E−17 |
| Observed value | 255 |

TABLE 2

| | F | P |
|---|---|---|
| Regression analysis | 6.61024E+33 | 0 |

TABLE 3

| | Coefficient | Standard error |
|---|---|---|
| $a_0$ | −2.74725E−17 | 1.1436E−17 |
| $a_1$ | 2.51118E−16 | 3.46128E−16 |
| $a_2$ | 1.19657E−14 | 1.07665E−14 |
| $a_3$ | 1 | 3.14354E−15 |
| $a_4$ | −9.29366E−15 | 8.8134E−15 |
| $a_5$ | 1.22505E−15 | 8.62218E−16 |

For example, as can be seen from Table 1, the correlation coefficient R is 1, which indicates that the degree of correlation between x and y is significantly positive correlation. As can be seen from Table 2, the value of P is 0, which is less than a significance level of 0.05, which indicates that a regression effect of the model expression is remarkable. Specific values of the coefficients $a_0$ to $a_5$ in the model expression (1) can be seen from Table 3, so that the model expression after the specific values of coefficients are determined is:

$$z=-2.74725E-17+2.51118E-16x+1.19657E-14y+xy+(-9.29366E-15x^2)+1.22505E-15y^2 \quad (2)$$

In a case where the image data analysis model is the model expression (2), for example, a group of gray levels is randomly selected from 0 to 255 gray levels. For example, levels of a group of gray levels that is randomly selected are 0, 1, 31, 63, 127, 191, 223, 254, and 255. A first light transmittance corresponding to each gray level in the group of gray levels is obtained according to the first gamma curve (e.g., the gamma 1.0 curve), and a second light transmittance corresponding to each gray level in the group of gray levels is obtained according to the second gamma curve (e.g., the gamma 2.2 curve). The first light transmittance corresponding to each gray level is taken as the value of x, and the second light transmittance corresponding to the same gray level is taken as the value of y, then they are substituted into the model expression (2), and the actual light transmittance z of the display panel after fitting can be determined through calculation. In addition, by measuring the actual light transmittance of the display panel or according to the third gamma curve (e.g., the gamma 3.2 curve), a verification light transmittance z' of the display panel corresponding to each gray level in the group of gray levels can be obtained.

The first light transmittance (x), the second light transmittance (y), the actual light transmittance z of the display panel after fitting, and the verification light transmittance z' of the display panel corresponding to each gray level in the above group of gray levels are as shown in Table 4.

For example, as shown in Table 4, a level of the gray level is 31, a corresponding first light transmittance is 12.157%, and a corresponding second light transmittance is 0.970%. The first light transmittance 12.157% and the second light transmittance 0.970% are substituted into the model expression (2), and an actual light transmittance z of the display panel after fitting corresponding to the gray level 31 can be determined to be 0.118% by calculation. Then, the verification light transmittance z' of the display panel corresponding to the gray level 31 is 0.118%, which is obtained according to the third gamma curve. In this way, comparing the actual light transmittance 0.118% (z) of the display panel after fitting corresponding to the gray level 31 with the verification light transmittance 0.118% (z') of the display panel corresponding to the same gray level, the deviation between the two is zero. Similarly, according to Table 4, it can be clearly known that, the deviation between the actual light transmittance z of the display panel after fitting corresponding to another gray level and the verification light transmittance z' of the display panel corresponding to the same gray level is zero or approaches zero. This also illustrates that the model expression (2) in some embodiments above (or the model expression (1)) can well represent a correspondence of the actual light transmittance of the display panel, the first light transmittance of the dimming sub-panel 1 and the second light transmittance of the display sub-panel 2, thereby ensuring that the model expression (1) is reasonably available and has a high fitting accuracy.

Herein, it will be noted that, the values of coefficients in the model expression (1) are related to the corresponding gray level samples, the first gamma curve, the second gamma curve, and the analysis tool. In some examples, the values of coefficients in the model expression (1) differ from the corresponding coefficients in the model expression (2), which is also allowed. Some embodiments of the present disclosure do not limit this.

TABLE 4

| | Regression fitting | | | | | | |
|---|---|---|---|---|---|---|---|
| | Dimming sub-panel | Display sub-panel | | | | Display panel | |
| Gray level | x 1 | y 2.2 | xy | 2 | 2 | z' 3.2 | z Fitting result |
| 0 | 0.000% | 0.000% | 0.000% | 0.000% | 0.000% | 0.000% | 0.000% |
| 1 | 0.392% | 0.001% | 0.000% | 0.002% | 0.000% | 0.000% | 0.000% |
| 31 | 12.157% | 0.970% | 0.118% | 1.478% | 0.009% | 0.118% | 0.118% |
| 63 | 24.706% | 4.615% | 1.140% | 6.104% | 0.213% | 1.140% | 1.140% |
| 127 | 49.804% | 21.576% | 10.746% | 24.804% | 4.655% | 10.746% | 10.746% |
| 191 | 74.902% | 52.952% | 39.662% | 56.103% | 28.039% | 39.662% | 39.662% |
| 223 | 87.451% | 74.453% | 65.110% | 76.477% | 55.433% | 65.110% | 65.110% |
| 254 | 99.608% | 99.139% | 98.751% | 99.217% | 98.286% | 98.751% | 98.751% |
| 255 | 100.000% | 100.000% | 100.000% | 100.000% | 100.000% | 100.000% | 100.000% |

In some examples, there may be other choices of the analysis tool, such as MATLAB. According to different analysis tools, the obtained image data analysis models may be different, so that the obtained analysis results will also be different. In this regard, the present disclosure does not limit the choice of analysis tools, so long as the nonlinear regression analysis of some embodiments of the present disclosure may be achieved.

In the image processing method of the display panel of some embodiments of the present disclosure, in S200, the first gray level of at least one of the plurality of first sub-pixels 101 and the second gray levels of at least two second sub-pixels 201 corresponding to each of the at least one first sub-pixel 101 are obtained.

In some examples, for clarity of illustration, by taking one of the at least one first sub-pixel 101 and four second sub-pixels 201 corresponding thereto (i.e., a group of sub-pixels) as an example, S200 to S400 are continued to be described.

For example, in a group of sub-pixels, a first gray level 156 of the first sub-pixel is obtained, and second gray levels of the four second sub-pixels 201 corresponding to the first sub-pixel are obtained, in which the second gray levels are a second gray level 156, a second gray level 148, a second gray level 60 and a second gray level 100. Herein, the first gray level 156 is equal to the largest second gray level among the corresponding four second gray levels (i.e., the second gray level 156). Therefore, the second sub-pixels 201 corresponding to the second gray level 148, the second gray level 60, and the second gray level 100 are relatively bright.

In the image processing method of the display panel in some embodiments of the present disclosure, in S300, the first light transmittance corresponding to the first gray level of the at least one first sub-pixel and the second light transmittances corresponding to the second gray levels of the at least two second sub-pixels 201 corresponding to each of the at least one first sub-pixel are obtained, and the actual light transmittances corresponding to the second gray levels of the at least two second sub-pixels are determined respectively by using the image data analysis model.

For example, according to the first gamma curve of the dimming sub-panel 1 (e.g., the gamma 1.0 curve), a first light transmittance corresponding to the first gray level 156 is obtained. According to the second gamma curve of the display sub-panel 2 (e.g., the gamma 2.2 curve), a second light transmittance corresponding to the second gray level 156, a second light transmittance corresponding to the gray level 148, a second light transmittance corresponding to the gray level 60, and a second light transmittance corresponding to the gray level 100 are obtained.

In some embodiments, in S300, determining the actual light transmittances corresponding to the gray levels of the at least two second sub-pixels 201 respectively by using the image data analysis model, further includes:

taking the first light transmittance corresponding to the first gray level of the at least one first sub-pixel 101 as the value of x, and taking the second light transmittance corresponding to the second gray level of each of the at least two second sub-pixels corresponding to each of the at least one first sub-pixel as the value of y, and substituting them into the model expression of the image data analysis model, and determining the actual light transmittance corresponding to the second gray level of each of the at least two second sub-pixels 201 corresponding to each of the at least one first sub-pixel 101 according to the model expression.

For example, the image data analysis model is the model expression (2), the first light transmittance corresponding to the first gray level 156 is taken as the value of x, the second light transmittance corresponding to the second gray level 156 is taken as the value of y, then they are substituted into the model expression (2), and an actual light transmittance corresponding to the second gray level 156 is calculated to be 20.752%. Then, the first light transmittance corresponding to the first gray level 156 is taken as the value of x, the second light transmittance corresponding to the second gray level 148 is taken as the value of y, then they are substituted into the model expression (2), and an actual light transmittance corresponding to the second gray level 148 is calculated to be 18.483%. Herein, the calculation methods of actual light transmittances corresponding to the second gray level 60 and the second gray level 100 are deduced by analogy, which will not be repeated here. Finally, an actual light transmittance corresponding to the second gray level 60 obtained through calculation is 2.536%, and an actual light transmittance corresponding to the second gray level 100 obtained through calculation is 7.802%.

In the image processing method of the display panel in some embodiments of the present disclosure, in S400, target light transmittances corresponding to the second gray levels of the at least two second sub-pixels 201 are respectively obtained, and compensation gray levels corresponding to the at least two second sub-pixels 201 are determined according to the actual light transmittances and the target light transmittances corresponding to the second gray levels of the at least two second sub-pixels 201.

In some embodiments, in S400, obtaining the target light transmittances corresponding to the second gray levels of the at least two second sub-pixels 201, further includes: obtaining the target light transmittances corresponding to the second gray levels of the at least two second sub-pixels 201 according to the third gamma curve of the display panel respectively.

For example, according to the third gamma curve of the display panel (e.g., the gamma 3.2 curve), a light transmittance corresponding to the second gray level 156 is obtained, which is 20.752%, and the light transmittance 20.752% is a target light transmittance corresponding to the second gray level 156. Similarly, according to the third gamma curve of the display panel (e.g., the gamma 3.2 curve), a target light transmittance corresponding to the second gray level 148 being 17.535%, a target light transmittance corresponding to the second gray level 60 being 0.975%, and a target light transmittance corresponding to the second gray level 100 being 5.001% are obtained.

In some embodiments, before determining the compensation gray levels corresponding to the at least two second sub-pixels 201, the method further includes S410.

In S410, according to a difference between the actual light transmittance and the target light transmittance that are corresponding to the second gray level of each of the at least two second sub-pixels 201, whether to compensate for the second gray level of each of the at least two second sub-pixels 201 is judged; and if yes, the compensation gray level corresponding to each of the at least two second sub-pixels 201 is determined.

In some embodiments, judging whether to compensate for the second gray level of each of the at least two second sub-pixels 201, includes S411 and S412.

In S411, a difference between an actual light transmittance and a target light transmittance that are corresponding to the second gray level of each of the at least two second sub-pixels 201 is obtained.

In S412, whether an absolute value of the difference is greater than or equal to the threshold is judged; and if yes, the second gray level of the second sub-pixel 201 corresponding to the difference is compensated.

In some embodiments, the threshold is 0.995% to 1.005%. In some embodiments of the present disclosure, the threshold being 1% is taken as an example for description.

In some examples, in the group of sub-pixels (the first gray level 156 corresponding to the second gray level 156, the second gray level 148, the second gray level 60, and the second gray level 100), the second gray level 100 is taken as an example for illustration.

For example, the actual light transmittance corresponding to the second gray level 100 is 7.802%, the target light transmittance corresponding to the second gray level 100 is 5.001%, and a difference between the actual light transmittance and the target light transmittance corresponding to the second gray level 100 is 2.801%. Since 2.801% is greater than the threshold 1%, there is a need to compensate for the second gray level 100.

In some embodiments, determining a compensation gray level of the second sub-pixel 201 corresponding to the difference, further includes S420.

In S420, whether an actual light transmittance corresponding to the second gray level of the second sub-pixel 201 is greater than a target light transmittance corresponding thereto is judged;

if yes, the second gray level of the second sub-pixel 201 is reduced by stages until the absolute value of the difference between the actual light transmittance and the target light transmittance corresponding to the second gray level of the second sub-pixel 201 is less than the threshold, then the reduced second gray level of the second sub-pixel 201 is the compensation gray level corresponding to the second sub-pixel 201; and if not, the second gray level of the second sub-pixel 201 is increased by stages until the absolute value of the difference between the actual light transmittance and the target light transmittance corresponding to the second gray level of the second sub-pixel 201 is less than the threshold, then the increased second gray level of the second sub-pixel 201 is the compensation gray level corresponding to the second sub-pixel 201.

For example, the second gray level 100 is continued to be taken as an example for illustration. In S410, it has been determined that the second gray level 100 needs to be compensated. Herein, the process of determining the compensation gray level of the second gray level 100 is: judging whether the actual light transmittance corresponding to the second gray level 100 is greater than the target light transmittance corresponding thereto; the actual light transmittance corresponding to the second gray level 100 is 7.802%, and the target light transmittance corresponding to the second gray level 100 is 5.001%. Thus, the actual light transmittance corresponding to the second gray level 100 is greater than the target light transmittance corresponding thereto. Then, starting from the second gray level 100, the second gray level 100 is reduced by stages (e.g., a gray level 99, a gray level 98, a gray level 97, . . . ), so as to cyclically search a new second gray level as the compensation gray level of the second gray level 100. A sign indicating that the new second gray level (the compensation gray level) is found out is that: an absolute value of a difference between an actual light transmittance corresponding to the new second gray level (the compensation gray level) and a target light transmittance corresponding thereto is less than the threshold 1% for the first time.

For example, the second gray level 100 is reduced by stages, and when it is reduced to a gray level 88, an actual light transmittance of the gray level 88 is 5.889%. In addition, an absolute value of a difference between the actual light transmittance 5.889% of the gray level 88 and the target light transmittance 5.001% of the second gray level 100 is 0.888%, which is less than the threshold 1%. Therefore, the gray level 88 is the new second gray level, that is, the gray level 88 is the compensation gray level of the second gray level 100. Similarly, as shown in Table 5, compensation gray levels of the second gray level 156, the second gray level 148, the second gray level 60, and the second gray level 100 are determined.

TABLE 5

| Second gray level | Actual light transmittance | Compensation gray level | Actual light transmittance corresponding to the compensation gray level | Target light transmittance | Original difference | Difference after compensation | Threshold |
|---|---|---|---|---|---|---|---|
| 156 | 20.752% | 156 | 20.752% | 20.752% | 0.000% | 0.000% | 1% |
| 148 | 18.483% | 148 | 18.483% | 17.535% | 0.948% | 0.948% | 1% |
| 60 | 2.536% | 53 | 1.930% | 0.975% | 1.561% | 0.955% | 1% |
| 100 | 7.802% | 88 | 5.889% | 5.001% | 2.801% | 0.888% | 1% |

For example, as can be seen from Table 5, an absolute value of a difference between the actual light transmittance and the target light transmittance of the second gray level 156 and of the second gray level 148 is less than the threshold 1%, therefore, compensation is not required. That is, a compensation gray level of the second gray level 156 is equal to itself, and a compensation gray level of the second gray level 148 is equal to itself. A method of determining a compensation gray level of the second gray level 60 is the same as a method of determining a compensation gray level of the second gray level 100, which will not be repeated here, and the compensation gray level 53 of the second gray level 60 can be obtained. Thus, all the compensation gray levels corresponding to the second gray level 156, the second gray level 148, the second gray level 60, and the second gray level 100 are obtained. Therefore, in the group of sub-pixels, an absolute value of a difference between the actual light transmittance corresponding to the second gray level 60 and the target light transmittance corresponding thereto is less than the threshold 1%, and an absolute value of a difference between the actual light transmittance corresponding to the second gray level 100 and the target light transmittance corresponding thereto is less than the threshold 1%, and thereby a problem that the second sub-pixels 201 corresponding to the second gray level 60 and the second gray level 100 respectively are relatively bright is improved.

In addition, it will be added that, in a case where a second gray level of any second sub-pixel 201 is determined to be compensated, and an actual light transmittance corresponding to the second gray level to be compensated is less than the target light transmittance corresponding thereto, the second gray level to be compensated is increased by stages to circularly search its compensation gray level. The method of circular search is the same as the method of circular search when the compensation gray level of the second gray level 100 is determined. The difference lies in that a direction of the circular search in the above case is opposite to a direction of the circular search of the second gray level 100.

In summary, through the image processing method in some embodiments of the present disclosure, it may be ensured that the absolute value of the difference between the actual light transmittance corresponding to the second gray level of any second sub-pixel in the display sub-panel and the target light transmittance corresponding thereto is less than the threshold, so that the problem of any second sub-pixel being relatively bright or relatively dark may be improved, thereby improving the problem of halo of the display panel.

The above mainly introduces the image processing method provided by some embodiments of the present disclosure. In some embodiments of the present disclosure, an image processing device 500 that implements the above image processing method is also provided, and the image processing device 500 will be exemplarily introduced below.

Figure 9:
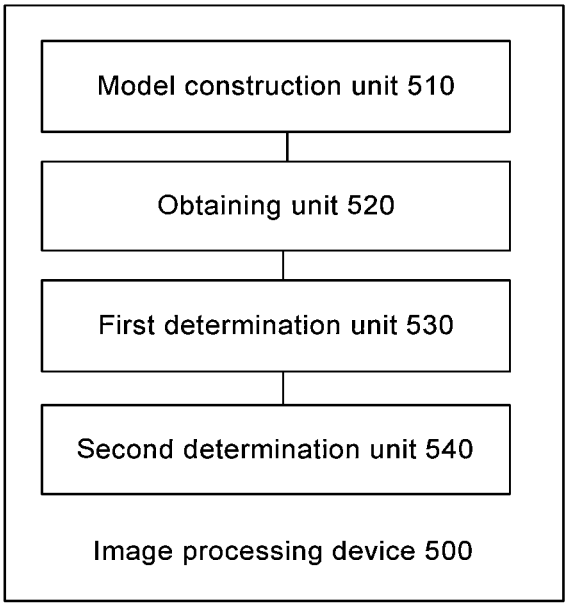
FIG. 9 is a schematic diagram of an image processing device, in accordance with some embodiments of the present disclosure.

In some embodiments, as shown in FIG. 9, the image processing device 500 includes a model construction unit 510, an obtaining unit 520, a first determination unit 530 and a second determination unit 540. The model construction unit 510 is configured to construct the image data analysis model. The image data analysis model is used to represent the relationship among the actual light transmittance of the display panel, the first light transmittance of the dimming sub-panel 1, and the second light transmittance of the display sub-panel 2. The obtaining unit 520 is configured to obtain the first gray level of at least one of the plurality of first sub-pixels, and the second gray levels of the at least two second sub-pixels corresponding to each of the at least one first sub-pixel. The first determination unit 530 is configured to obtain the first light transmittance corresponding to the first gray level of the at least one first sub-pixel and the second light transmittances corresponding to the second gray levels of the at least two second sub-pixels corresponding to each of the at least one first sub-pixel, and determine the actual light transmittances corresponding to the second gray levels of the at least two second sub-pixels by using the image data analysis model. The second determination unit 540 is configured to respectively obtain the target light transmittances corresponding to the second gray levels of the at least two second sub-pixels, and determine the compensation gray levels corresponding to the at least two second sub-pixels according to the actual light transmittances corresponding to the second gray levels of the at least two second sub-pixels and the target light transmittances corresponding thereto.

It will be noted that, for the convenience and conciseness of the description, the specific operating processes of the device and units described above may refer to the corresponding processes in the method in the foregoing embodiments, which will not be repeated here.

Figure 10:
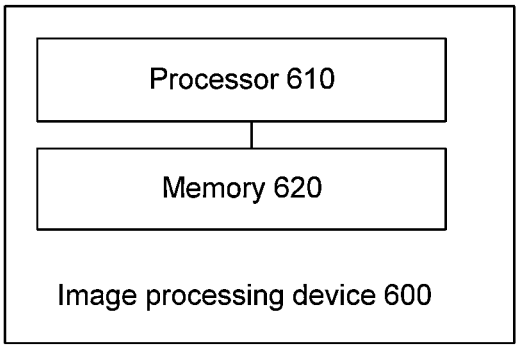
FIG. 10 is a schematic diagram of another image processing device, in accordance with some embodiments of the present disclosure.

In some other embodiments, an image processing device 600 is further provided. As shown in FIG. 10, the image processing device 600 includes a processor 610 and a memory 620. The processor 610 is configured to support the image processing device 600 to perform the above image processing method, and/or is configured to support other processes of the technology described herein.

For example, the processor 610 may be a central processing unit (CPU), or may be other general-purpose processor, a digital signal processor (DSP), an application specific integrated circuit (ASIC), a field programmable gate array (FPGA) or other programmable logic device, a discrete gate or a transistor logic device, a discrete hardware component, etc. The general-purpose processor may be a microprocessor, or may be any conventional processor, or the like.

For example, the memory 620 is configured to store program codes and data of the image processing device provided by some embodiments of the present disclosure. The processor 610 may perform various functions of the image processing device 600 by running or executing software programs stored in the memory 620, and calling the data stored in the memory 620.

For example, the memory 620 may be a read-only memory (ROM) or another type of static storage device that may store static information and instructions, a random access memory (RAM), or another type of dynamic storage device that may store information and instructions, or may be an electrically erasable programmable read-only memory (EEPROM), a compact disc read-only memory (CD-ROM) or another compact disc storage, an optical disc storage (including compressed discs, laser discs, optical discs, digital versatile discs, Blu-ray discs, etc.), a magnetic disc storage medium or another magnetic storage device, or any other medium that may be used to carry or store a desired program code in the form of instructions or data structures and can be accessed by a computer, which is not limited thereto. The memory 620 may be separate and coupled to the processor via a communication bus. The memory 620 may also be integrated with the processor 610.

Those skilled in the art may realize that the units and algorithm steps of the examples described in combination with the embodiments disclosed herein may be implemented by electronic hardware, computer software, or a combination of both. In order to clearly illustrate an interchangeability of hardware and software, composition and steps of each example have been described generally in terms of functions in the above description. Whether these functions are executed in hardware or software depends on the specific application and design constraint conditions of the technical solution. Specialized technical personnel may use different methods to implement the described functions for each specific application, but such implementation should not be considered beyond the scope of some embodiments of the present disclosure.

In the embodiments provided in the present disclosure, it will be understood that the disclosed devices and method may be implemented in other manners. For example, the embodiments of the devices described above are only schematic. For example, the division of a unit is only a division of a logical function, and there may be other manners of division in actual implementation.

In addition, the shown or discussed mutual coupling or direct coupling or communication connection may be indirect coupling or communication connection through some interfaces, devices or units, and may be of electrical, mechanical or other forms.

The units described as separate components may be or may not be physically separate, and the components displayed as units may be or may not be physical units. Some or all the units may be selected according to actual needs to achieve the objectives of the solutions in some embodiments of the present disclosure.

In addition, the functional units in some embodiments of the present disclosure may be integrated in one processing unit, or each unit may exist physically, or two or more units may be integrated in one processing unit. The integrated unit may be implemented in the form of hardware or in the form of software functional unit.

In some examples, a computer program is provided. After the computer program is loaded into the processor, the processor is made to perform one or more steps in the image processing method described in any of the foregoing embodiments.

In some examples, a computer-readable storage medium is provided. For example, the computer-readable storage medium is a non-transitory computer-readable storage medium. The non-transitory computer-readable storage medium stores computer program instructions, and when the computer program instructions is run by the processor, one or more steps in the image processing method described in any of the foregoing embodiments are executed.

If the above integrated unit is implemented in the form of software functional unit, and is sold or used as an independent product, it may be stored in a non-transitory computer-readable storage medium. Based on this understanding, the technical solution of the present disclosure or a part of the technical solution that contributes to the prior art or a part of the technical solution may be embodied in the form of a software product. The software product is stored in a storage medium, including several instructions used to enable a computer device (which may be a personal computer, a server, a network device, etc.) to perform all or part of the steps of the method described in the embodiments of the present disclosure. The foregoing storage medium includes various types of medium that may store program code, such as a USB flash drive, a removable hard disk, a Read-Only Memory (ROM), a Random-Access Memory (RAM), a magnetic disk, or an optical disk.

The foregoing descriptions are merely specific implementation manners of the present disclosure, but the protection scope of the present disclosure is not limited thereto. Any changes or replacements that a person skilled in the art could readily conceive of within the technical scope of the present disclosure shall be included in the protection scope of the present disclosure. Therefore, the protection scope of the present disclosure shall be subject to the protection scope of the claims.

What is claimed is:

1. An image processing method applied to a display panel, the display panel including a dimming sub-panel and a display sub-panel that are disposed in a stack, the dimming sub-panel including a plurality of first sub-pixels, the display sub-panel including a plurality of second sub-pixels, and each of the plurality of first sub-pixels corresponding to at least two of the plurality of second sub-pixels;

the image processing method comprising:

constructing an image data analysis model, wherein the image data analysis model is used to represent a relationship among an actual light transmittance of the display panel, a first light transmittance of the dimming sub-panel and a second light transmittance of the display sub-panel;

obtaining a first gray level of at least one first sub-pixel of the plurality of first sub-pixels, and second gray levels of at least two second sub-pixels corresponding to each of the at least one first sub-pixel;

obtaining a first light transmittance corresponding to the first gray level of the at least one first sub-pixel and second light transmittances corresponding to the second gray levels of the at least two second sub-pixels corresponding to each of the at least one first sub-pixel;

determining actual light transmittances corresponding to the second gray levels of the at least two second sub-pixels respectively according to the image data analysis model;

obtaining target light transmittances corresponding to the second gray levels of the at least two second sub-pixels respectively; and determining compensation gray levels corresponding to the at least two second sub-pixels according to the actual light transmittances and the target light transmittances corresponding to the second gray levels of the at least two second sub-pixels.

2. The image processing method according to claim 1, wherein constructing an image data analysis model, includes:

obtaining the first light transmittance corresponding to the dimming sub-panel and the second light transmittance corresponding to the display sub-panel at each of at least four gray levels according to a first gamma curve of the dimming sub-panel and a second gamma curve of the display sub-panel;

obtaining a third gamma curve corresponding to the display panel at an actual display state, and determining the actual light transmittance corresponding to the display panel at each of the at least four gray levels according to the third gamma curve; and taking the first light transmittance of the dimming sub-panel and the second light transmittance of the display sub-panel as independent variables, the actual light transmittance of the display panel as a dependent variable, and performing nonlinear regression analysis, so as to construct the image data analysis model.

3. The image processing method according to claim 2, wherein obtaining target light transmittances corresponding to the second gray levels of at least two second sub-pixels, includes:

obtaining the target light transmittances corresponding to the second gray levels of the at least two second sub-pixels according to the third gamma curve of the display panel respectively.

4. The image processing method according to claim 2, wherein the nonlinear regression analysis includes:

supposing a model expression, and the model expression being:

$$z=a_0+a_1x+a_2y+a_3xy+a_4x^2+a_5y^2$$

where x is the first light transmittance of the dimming sub-panel, y is the second light transmittance of the display sub-panel, z is the actual light transmittance of the display panel, and $a_0$ to $a_5$ are different coefficients in the model expression; and substituting values of x, y and z corresponding to each of the at least four gray levels into the model expression, and using an analysis tool to obtain values of different coefficients in the model expression and analysis results.

5. The image processing method according to claim 4, wherein determine actual light transmittances corresponding to the second gray levels of the at least two second sub-pixels respectively by using the image data analysis model, includes:

taking the first light transmittance corresponding to the first gray level of the at least one first sub-pixel as a value of x, the second light transmittance corresponding to a second gray level of each of the at least two second sub-pixels corresponding to each of the at least one first sub-pixel as a value of y, and substituting them into the model expression of the image data analysis model; and respectively determining actual light transmittances corresponding to the second gray levels of the at least two second sub-pixels corresponding to each of the at least one first sub-pixel according to the model expression.

6. The image processing method according to claim 1, wherein obtaining a first light transmittance corresponding to the first gray level of the at least one first sub-pixel and second light transmittances corresponding to the second gray levels of the at least two second sub-pixels corresponding to each of the at least one first sub-pixel, includes:

obtaining the first light transmittance corresponding to the first gray level of the at least one first sub-pixel according to a first gamma curve of the dimming sub-panel; and obtaining the second light transmittances corresponding to the second gray levels of the at least two second sub-pixels corresponding to each of the at least one first sub-pixel according to a second gamma curve of the display sub-panel.

7. The image processing method according to claim 1, wherein before determining compensation gray levels corresponding to the at least two second sub-pixels, the method further comprises:

judging whether to compensate for a second gray level of each of the at least two second sub-pixels according to a difference between the actual light transmittance corresponding to the second gray level of each of the at least two second sub-pixels and the target light transmittance corresponding thereto; and if yes, determining a compensation gray level corresponding to each of the at least two second sub-pixels.

8. The image processing method according to claim 7, wherein judging whether to compensate for a second gray level of each of the at least two second sub-pixels, includes:

obtaining a difference between an actual light transmittance and a target light transmittance corresponding to the second gray level of each of the at least two second sub-pixels;

judging whether an absolute value of the difference is greater than or equal to a threshold; and if yes, compensating for the second gray level of the second sub-pixel corresponding to the difference.

9. The image processing method according to claim 8, wherein determining a compensation gray level of the second sub-pixel corresponding to the difference, includes:

judging whether the actual light transmittance corresponding to the second gray level of the second sub-pixel is greater than the target light transmittance corresponding thereto;

if yes, reducing the second gray level of the second sub-pixel by stages until the absolute value of the difference between the actual light transmittance and the target light transmittance corresponding to the second gray level of the second sub-pixel is less than the threshold, then the reduced second gray level of the second sub-pixel is the compensation gray level corresponding to the second sub-pixel; and if not, increasing the second gray level of the second sub-pixel by stages until the absolute value of the difference between the actual light transmittance and the target light transmittance corresponding to the second gray level of the second sub-pixel is less than the threshold, then the increased second gray level of the second sub-pixel is the compensation gray level corresponding to the second sub-pixel.

10. The image processing method according to claim 8, wherein the threshold is 0.995% to 1.005%.

11. An image processing device, comprising:

a model construction unit configured to construct an image data analysis model, wherein the image data analysis model is used to represent a relationship among an actual light transmittance of a display panel, a first light transmittance of a dimming sub-panel and a second light transmittance of a display sub-panel;

an obtaining unit configured to obtain a first gray level of at least one of a plurality of first sub-pixels, and second gray levels of at least two second sub-pixels corresponding to each of the at least one first sub-pixel;

a first determination unit configured to obtain a first light transmittance corresponding to the first gray level of the at least one first sub-pixel and second light transmittances corresponding to the second gray levels of the at least two second sub-pixels corresponding to each of the at least one first sub-pixel, and determine actual light transmittances corresponding to the second gray levels of the at least two second sub-pixels according to the image data analysis model respectively; and a second determination unit configured to respectively obtain target light transmittances corresponding to the second gray levels of the at least two second sub-pixels, and determine compensation gray levels corresponding to the at least two second sub-pixels according to the actual light transmittances and the target light transmittances corresponding to the second gray levels of the at least two second sub-pixels.

12. An image processing device, comprising: a processor and a memory; wherein the processor is configured to be electrically connected to a display panel; and the memory stores computer program instructions suitable for being executed by the processor, and when the computer program instructions are run by the processor, one or more steps in the image processing method according to claim 1 are executed.

* * * * *